US005425310A

United States Patent [19]

Weber

[11] Patent Number: 5,425,310

[45] Date of Patent: Jun. 20, 1995

[54] RED POWDER ARTICLES AND COMPOSITIONS

[75] Inventor: Anton B. Weber, Montclair, N.J.

[73] Assignee: The United States of America as represented by the Secretary of the Army, Washington, D.C.

[21] Appl. No.: 265,462

[22] Filed: Jun. 10, 1994

Related U.S. Application Data

[63] Continuation-in-part of Ser. No. 94,411, Jul. 8, 1993, Pat. No. 5,320,691.

[51] Int. Cl.[6] ..... F42B 4/26

[52] U.S. Cl. ..... 102/342; 102/334

[58] Field of Search ..... 102/334, 342

[56] References Cited

U.S. PATENT DOCUMENTS 3,712,224 1/1973 Hanzel ..... 102/37.6
5,320,691 6/1994 Weber ..... 149/61
5,337,671 8/1994 Varmo ..... 102/334

*Primary Examiner*—Peter A. Nelson
*Attorney, Agent, or Firm*—Anthony T. Lane; Edward Goldberg; John E. Callaghan

[57] ABSTRACT

The invention concerns a red powder composition that is substitute for conventional black powder. It can be loose or consolidated forms. In a four grain combination, the red powder can be used as the propelling charge in hand-held rocket signals or flares. There are new methods for preparing the powder and new methods for fabricating articles. The chemical composition of red powder is a dispersion of phenolphthalein, alkali metal nitrate and sulfur in a binder of phenolphthalein salt.

7 Claims, 4 Drawing Sheets

RED POWDER ARTICLES AND COMPOSITIONS

CROSS-REFERENCE TO RELATED APPLICATIONS

This application is a continuation-in-part of application Ser. No. 094,411, filed 8, Jul. 1993, now U.S. Pat. No. 5,320,691.

FIELD OF THE INVENTION

The present application relates to the substitution of red powder energetic compositions for black powder in standard black powder type compositions and structures, such as hand-held military flares. It also includes novel methods of production.

BACKGROUND OF THE INVENTION

Signal rockets or flares are pyrotechnic devices which are well known articles of commerce. They are used on a large scale for signalling and terrain illumination. The signals are available with red, white, and green illuminants or with red, green, or yellow smoke. J.H. McLain, in "Pyrotechnics", The Franklin Institute Press, Philadelphia, Pa., 1980, pages 109 and 110 describes the M127A1 and related M125A1 and M126A1 hand held signal rockets. McLain also describes the weight, size, shape, and composition of the black powder propulsion pellet. A composition of 91% black powder, 9% calcium carbonate and a moisture content of 1.8–2.5% is described by McLain. The M127A1 signal rocket is fired by hand from an expendable launcher.

Signal rockets have been powered with black powder charges. A problem of black powder is its variable burning behavior from batch to batch. This variability originates from inconsistencies in the quality of charcoal which makes up ten percent of the black powder weight. As a result of this variability many black powder plants blew up so that, currently, there is only one domestic black powder plant. Thus, black powder's safety problem created also a single-source problem.

Accordingly, a need exists for a more reliable process and for substitute products which have approximately the same percentages of potassium nitrate and sulfur as black powder.

In my copending patent application Ser. No. 094,411, filed Jul. 8, 1993, which is herewith incorporated by reference, methods and compositions are described for articles and products that are made from charcoal-free black powder type granules that, in closed bomb tests, have a burn rate and pressure development rate comparable to that of standard black powder. The products are dispersions of unconverted phenolphthalein, potassium nitrate and sulfur in a binding phase of phenolphthalein salt. The products have a characteristic red color which is indicative of the presence of the phenolphthalein salt. For clarity in this specification, the energetic compositions of the earlier application will be hereinafter collectively referred to as "red powder".

Among the various pyrotechnic devices, the M127A1 signal rocket is an important technical demonstration because of the required cooperation of elements that is necessary to effect sequential burning of the initiating, expelling, delay and propelling charges of the signal rocket. This signal rocket has a minimal elevation of 650 feet, The benefits of the substitution of red powder granules and consolidated red powder in conventional articles which have used black powder are set forth in detail below.

SUMMARY OF THE INVENTION

The invention therefore relates to a process for preparation of red powder propellant compositions which comprises:

(a) mixing a concentrated alkali metal hydroxide solution with a solvent consisting of a mixture of denatured alcohol and water to form an alcoholic alkali metal hydroxide solution;

(b) mixing calcium carbonate, phenolphthalein, sulfur, and an alkali metal nitrate selected from potassium nitrate and sodium nitrate to form a mixture of solids;

(c) adding under mixing the alcoholic alkali metal hydroxide solution formed in step (a) to the mixture of solids formed in step (b) to form a soft clay-like product;

(d) kneading the clay-like product formed in step (c) to form a homogeneous product;

(e) further drying the homogeneous product formed under step (d) to a form an extrudable product;

(f) extruding the extrudable product formed under step (e) through a wire mesh screen to form a moist extrudate; and (g) further drying the moist extrudate formed under step (f) to a dry extrudate.

The invention also relates to consolidated red powder and to articles of consolidated red powder and to a method for preparation of a red powder propellant cylinder having a bore therethrough with utility as a propellant structure for signal rockets.

The invention further relates to granular red powder products with utility as initiating and expelling charges for signal rockets.

DRAWING REFERENCE NUMERALS

Figure 1:
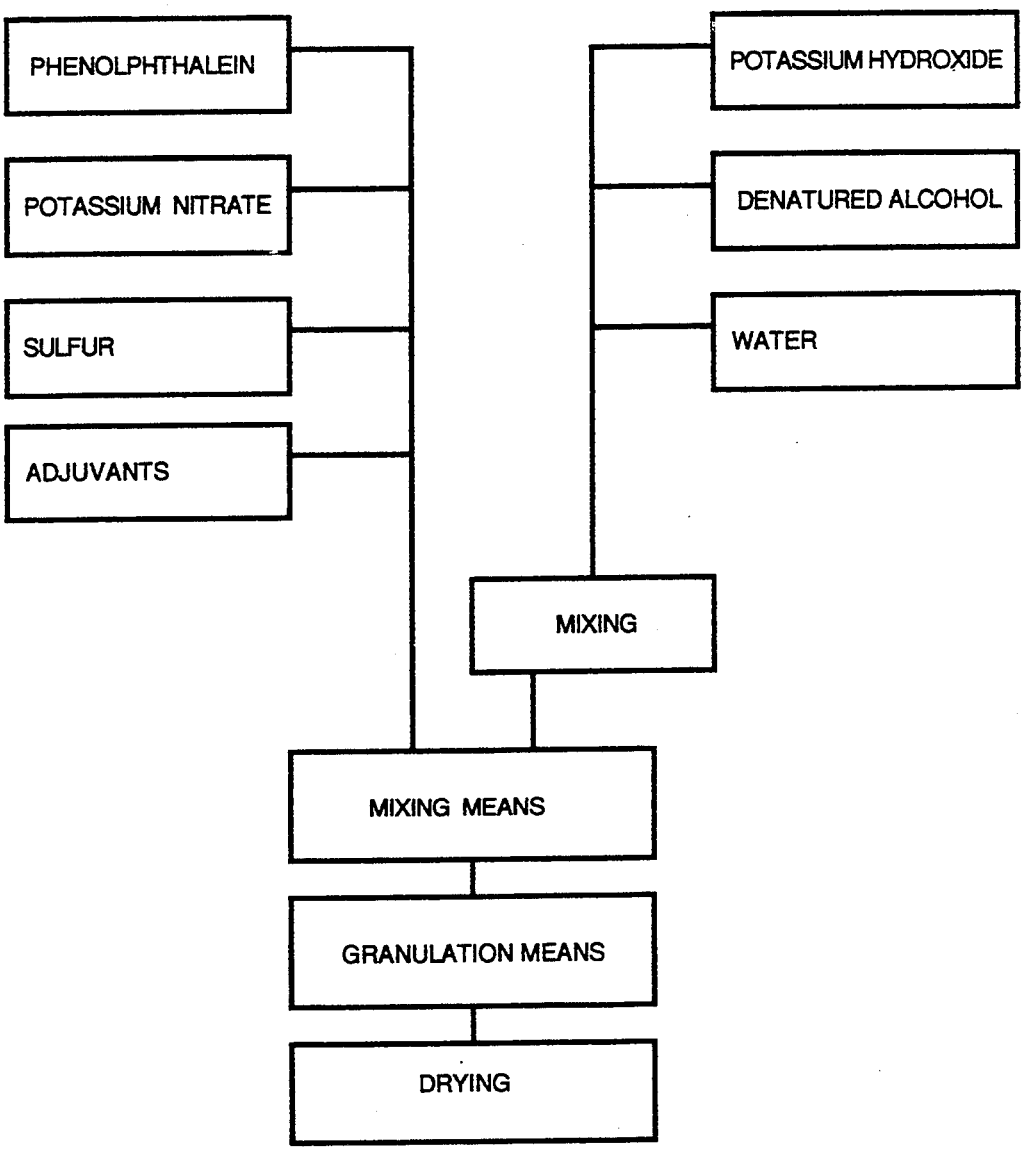
FIG. 1 is a diagram, largely in block form, that illustrates the process for red powder as earlier described in my copending application Serial No.: 094,411, dated Jul. 8, 1993. A batch of 1500 grams is described in Example 1.

20 Firing cap
22 Firing pin
24 Percussion cap
26 Black powder initiating charge
28 Venturi
30 Black powder propellant charge
32 Black powder delay charge
34 Black powder expelling charge
36 Illuminant assembly 38 Link
40 Parachute assembly
42 Cork seal
44 Signal casing
46 Tail assembly
48 Red powder expelling charge
50 Red powder propellant charge
52 Red powder initiating charge
56 Red powder propellant shape
58 Red powder propellant cylinder
60 Red powder propellant cylinder bore

DESCRIPTION OF THE PREFERRED EMBODIMENTS

The specifications for raw materials and equipment used in the invention are listed below:

RAW MATERIALS AND EQUIPMENT

1. YELLOW PHENOLPHTHALEIN, POWDER, U.S.P GRADE Supplier: CERES CHEMICAL CO. INC. Address: 550 Mamaroneck Ave, Harrison, NY 10528
2. POTASSIUM NITRATE, Class C Military Specification: MIL-P-156B
3. SULFUR POWDER, Ground Military Specification: MIL-S-14929 POTASSIUM HYDROXIDE, 45% SOLUTION, Reagent grade Source: Spectrum Chemical Mfg. Corp. 755 Jersey Avenue, New Brunswick, NJ 08901
4. CALCIUM CARBONATE, Precipitated Military Specification: MIL-C-293 Source: Charles Pfizer & Son; nominal particle size 8 microns; moisture content 2%.
5. DENATURED ALCOHOL Source: Spectrum Chemical Mfg. Corp. 755 Jersey Avenue, New Brunswick, NJ 08901
6. BLACK POWDER INITIATING CHARGE FOR M127A1 ROCKET Military Specification: MIL-P-223 Black powder, Class V, −16+40 mesh Quantity: 710 milligrams Source: GOEX Corporation, Moosic, PA.
7. BLACK POWDER EXPELLING CHARGE FOR M127A1 ROCKET Military Specification: MIL-P-223 Black powder, Class V, −16+40 mesh Quantity: 750 milligrams Source: GOEX Corporation, Moosic, PA.
8. BLACK POWDER PROPELLANT COMPOSITION FOR M127A1 Rocket Military Specification: MIL-A-2550. The propellant composition is a blend of black powder and calcium carbonate in a 91:9 ratio by weight. Required granulation for black powder: +20 mesh: 3% max.; −20+40 mesh: 60% max.; −80 mesh: 5% max.
9. BLACK POWDER PROPELLANT ASSEMBLY FOR M127A1 ROCKET. Military Specification: MIL-A-2550 The articles of the invention can be devices having consolidated red powder propellant shapes. The shapes can be solid plugs or rods. The shapes can also be hollow forms or solid cylinders with a center bore therethrough, often referred to as grains in the hand-held signal industry. The grains are prepared by tabletting the powder propellant composition described above. The specified dimensions for the grains in the M127A1 signal rocket are: inside diameter×outside diameter×height=0.35 inch×0.968 inch×0.693 inch. For conventional black powder propellant the consolidated density of the grains is in the range from 1.82 to 1.89 grams per milliliter, and the weight of a grain is 13 grams. A 3-grain assembly for the M127A1 signal rocket has a total energetic weight of 39 grams. The grains are joined together with an adhesive and the assembly is wrapped with a paper sheath prior to mounting in the M127A1 signal rocket.
10. M127A1 HAND-HELD SIGNAL ROCKET Military specification: MIL-A-2550 Length×Diameter=10.1 inch×1.6 inch; Material of construction: aluminum barrel and body; design altitude: 650–700 ft.

DESCRIPTION OF THE PREFERRED EMBODIMENTS

The methods of producing energetic compositions, as described in my copending application, are used for the preparation of the red powder propellant compositions. Generally, there is a mixing step and a shaping step. The ingredients will contain the additives that are specified for a particular article. The military specification for the M127A1 hand-held signal rocket requires the use of calcium carbonate. When the consolidated propellant burns, the calcium carbonate decomposes into calcium oxide and carbon dioxide gas and provides for the gas volume, pressure and kinetic energy to propel the rocket. Other carbonates or gas generants can be used.

Figure 2:
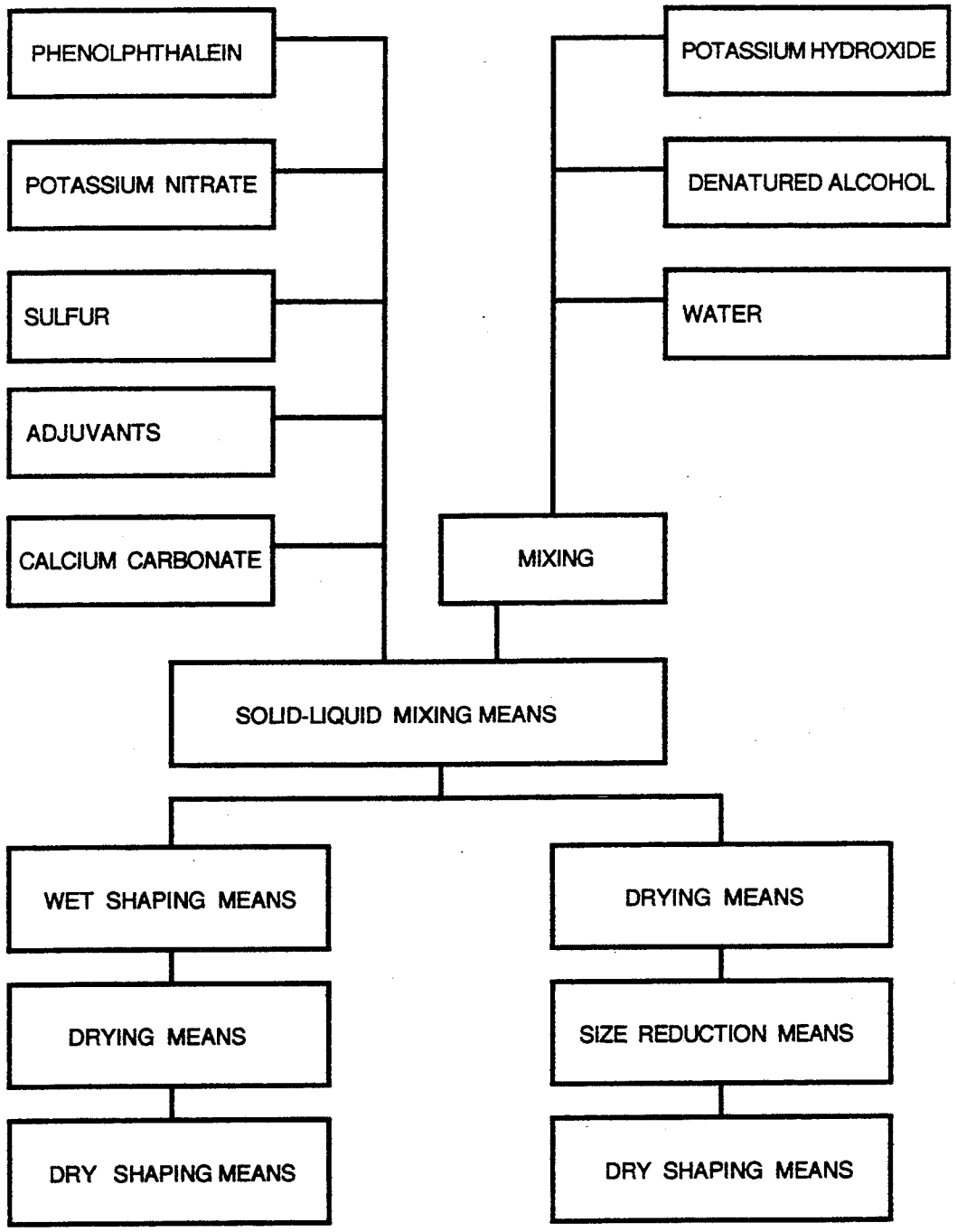
FIG. 2 is a block diagram illustrating the process for producing the granular form of red powder and the articles with the consolidated form of red powder.

The novel method for shaped red powder propellant compositions, shown in FIG. 2, has a mixing step (a) which includes:

(i) mix a concentrated alkali metal hydroxide solution with a solution consisting of a mixture of denatured alcohol and water to form an alcoholic alkali metal hydroxide solution; (ii) mix calcium carbonate, phenolphthalein, sulfur, and an alkali metal nitrate selected from potassium nitrate and sodium nitrate to form a mixture of solids; (iii) add under mixing the alcoholic alkali metal hydroxide solution formed in step (i) to the mixture of solids formed in step (ii) to form a soft clay-like product; (iv) knead the clay-like product formed in step (iii) to form a homogeneous product; (v) further dry the homogeneous product formed under step (iv) to a form an extrudable product; and a shaping step (b) which includes:

(1) extrude the extrudable product formed under step (a) (v) through a wire mesh screen to form a moist extrudate; and (ii) further dry the moist extrudate formed under (b)(i) to a dry extrudate.

With reference to FIG. 2, the preferred amount of calcium carbonate from about 4 to about 10% by weight based on dry solids. The calcium carbonate is conveniently added with the other solid raw materials to the mixer, for example a mixmuller, prior to adding the alcoholic solution of potassium hydroxide to the mixmuller. A preferred texture results from combining about 2.1 lbs of solids with about 1.0 lb of liquid. By applying this ratio, the solid-liquid mixture is a semisoft solid which turns over well during mixing, a condition needed to homogenize the mixture in a relatively short time, i.e. from about 10 to about 30 minutes. In softer mixtures that contain more liquid, the mixing time must be unduly extended in order to reach the required texture through forced or natural evaporation of the excess alcohol from the mixture. After proper mixing, the homogeneous mixture is a dispersion of calcium carbonate, unconverted phenolphthalein, potassium nitrate and sulfur in a binding phase of phenolphthalein salt.

The semisoft red powder propellant mixture has the same characteristic red color as a red powder mixture, because of the presence of alkaline phenolphthalein salt in the mixture. For clarity, the novel propellant compositions will be hereinafter collectively referred to as "red powder propellant".

Subsequent to the mixing step in the mixmuller, the semisoft red powder propellant can be shaped by shaping means, for example by extruders, pellet mills, and briquetting machines. A tablet machine requires a dryer product, which can be obtained by drying the semisoft red powder propellant. Clearly, a large variety of shaped products can be prepared and additional shape variations can be obtained by choosing the shape of the orifices of the dies of the shaping means.

As far as production costs are concerned, extrusion is a low cost operation and, therefore, the red powder and red powder propellant mixtures are preferably extruded. The extrudate can be cut into short sections to form rod or tablet like products. If the extrudate is cut in longer sections, for example with a length/diameter ratio of 2 to 3, the extrudate would be in the shape of short strands.

The extrudability of a particular mixture of red powder or red powder propellant can be tested by an artisan in the laboratory by: (a) preparing a mixture using a porcelain mortar and pestle; and (b) forcing the clay-like mixture solids through the openings of a wiremesh screen using a rubber stopper. Only when the product has the proper texture, the extrusion test will be successfull. If the product is too hard it can not be forced through the screen openings. If the product is too soft it will not shape and will merely stick to the screen. Corrections to the mixture can be effected so that it will have a proper texture. Mesh sizes used in the extrusion test included 8, 10 and 12 mesh.

In other extension processes, red powder propellant can be extruded as hollow strands which, after cutting into short sections, would provide shapes in ring form. In still another shaping process, semisoft short extrudates can be spherodized in conventional equipment to form spherical shapes. Small diameter microspheres can be formed by preparing red powder and red powder propellant batches in diluted form resembling paint like slurries and spraydrying the slurries in conventional equipment. The product are the microspheres.

Subsequent to the shaping of semisoft red powder propellant, the shapes are dried from a semisoft state to a dry state having about 1 to about 3% by weight of moisture. Overdrying should be avoided because the presence of moisture in the products helps to avoid the accumulation of static electrical charges during handling of the products. Another advantage of the presence of a few percent free moisture is that water is known to be an effective binder for consolidation and is benefecial for consolidation or shaping the dried product into grains, tablets or other shapes. Thus, a few percent of free moisture in dried red powder propellant will not only improve the operational safety, but will also be advantageous for consolidation after drying and, thus, provide for more perfect shapes and greater strength of the consolidated products. The drying of semisoft red powder and red powder propellant after the mixing step can be conducted in flowing air having a temperature between ambient and about 100° C. for an appropriate time. The drying step can be carried out with conventional batch or continuous drying means as for example, e.g. vibrating dyers, or continuous rotary dryers.

The red powder and red powder propellant semisoft mixed products, if prepared according to the diagrams in FIGS. 1 and 2, and extruded by manually pressing the products through a wire mesh screen, have an irregular shape and a relatively low bulk density. The products are hereinafter referred to as granular products. For certain applications, it can be advantageous to prepare granular products with a higher density.

In this alternate process, shown in FIG. 2, the red powder and red powder propellant mixture from the mix muller are first dried by drying means, reduced in size by size reduction means, shaped by shaping means and consolidated by consolidating means.

Consolidated red powder and red powder propellant of higher density can be prepared by compressing granular dried red powder or granular red powder propellant into high-density shapes, followed by crushing the shapes and screening the crushed product. The crushed product is then pressed into the shape of the desired article. This process is similar to that used in the preparation of conventional granular black powder.

Tabletting of black powder propellant compositions is carried out on conventional tablet machines, set up to produce tablets with a center bore therethrough. The red powder compositions can be consolidated into tablets with the same equipment. These shapes are referred to as propellant grains by producers of signal rockets.

The consolidated density of conventional black powder propellant is 1.82–1.89 grams/cubic centimeter and the tablet machine is set to reach this density. Since the bulk density of the granular red powder propellant is less than the bulk density of the loose black powder propellant composition before tabletting, the red powder propellant grains are shorter. At the same settings of the tabletting machine, the red powder propellant grains were shorter. The problem was solved, as described in Example 3 below, by using 4 red powder propellant grains in each M127A1 signal rocket.

Another method to solve the aforementioned problem is by densifying the granular red powder propellant. A process used in the tablet industry to effect partial consolidation is called "slugging" which comprises the crude tabletting of a low density feed. The denser slugs are crushed and screened to a smaller particle size range and re-fed to the tablet machine for tabletting.

Other general improvements for tabletting and consolidation processes include the addition of binders, lubricants and inert fillers. These improvements are well known to the artisan skilled in the tabletting process and are also applicable to shaped red powder and shaped red powder propellant. The adjuvants are preferably added before or during the solid-liquid mixing step of the respective processes. Generally, inert adjuvants will reduce the energetic output of red powder and red powder propellant, but their presence in small amounts can be very beneficial. For example, graphite is a well-known lubricant which improves the production rate of consolidated shapes by avoiding sticking of the shapes in the dies or molds of the consolidating means and by avoiding chipping of the consolidated shapes. Well-known binders that can improve the geometric accuracy and physical strength of tablets and consolidated shaped products include water, stearic acid and a multitude of additives well known in this art.

The invention will now be illustrated with the aid of the following examples which are not to be construed as limiting the invention.

EXAMPLE 1

Preparation of red powder

In this example, a process described in my earlier patent application Ser. No. 094,411, dated 8, Jul. 1993, was scaled up to 1500 grams. A block diagram for the scaled-up process is provided in FIG. 1. The batch was prepared to provide sufficient material to illustrate the use of granular red powder as a replacement charge for the black powder initiating and expelling charges in M127A1 signal rockets.

Preparation:

In a first step, phenolphthalein (222 grams), potassium nitrate (1045 grams) and sulfur (164 grams) were added to a mixmuller of 12" diameter by 4.5" depth. The mixer was turned on for approximately two minutes to mix and delump the solids;

In a second step, an alcoholic potassium hydroxide solution (69.0 grams potassium hydroxide, as a 20% solution in aqueous denatured alcohol prepared by mixing 153 grams of 45% potassium hydroxide solution with 192 grams denatured alcohol) was added to to the mixer.

In a third step, mixing of the solids with the liquid was continued for a total of 30 minutes.

In a fourth step, the deep-red colored mixture was manually transferred from the mix-muller to a ventilated fume hood for drying of the product. This was done by spreading out lumps of the semisoft product on a conductive plastic bag. The lumps were manually turned over at arbitrary intervals and the lumps allowed to dry at ambient temperature for 48 hours; and In a fifth step, the dry relatively large lumps of red powder were reduced in size by using a commercial Stokes granulator fitted with a 12 mesh screen. The minus 12 mesh red powder product was collected and stored in conductive plastic bags placed in metal containers.

The nominal composition of product on a dry basis was: 4.60% potassium hydroxide, 14.80% phenolphthalein, 69.67% potassium nitrate, and 10.93% sulfur. Following drying in the fume hood at ambient conditons, the resulting red powder contains from 1 to 3% moisture.

EXAMPLE 2

Preparation of red powder propellant

A block diagram for the process is provided in FIG. 2. A 1500 grams batch was prepared to illustrate the use of red powder propellant as a replacement charge for the black powder propelling charge in M127A1 signal rockets.

Preparation:

In a first step, phenolphthalein (209 grams), potassium nitrate (982 grams), sulfur (154 grams) and calcium carbonate (90.0 grams) were added to a mix-muller of 12" diameter by 4.5" depth, and the mixer turned on for approximately two minutes to mix and delump the solids;

In a second step, potassium hydroxide solution (65.0 grams potassium hydroxide, as a 15% solution in aqueous denatured alcohol, and prepared by mixing 144 grams of 45% potassium alcohol, and prepared by mixing 144 grams of 45% potassium hydroxide solution with 289 parts denatured alcohol) was added to to the mixer. Mixing was continued for a total of 45 minutes from start.

In a third step, the deep-red colored mixture was manually transferred from the mix-muller to a ventilated fume hood. The moist product was spread out on a conductive plastic bag in a layer of approximately 0.75 inch thick and allowed to dry at ambient temperature for 48 hours; and In a fourth step, the dried lumps of red powder propellant were granulated using a Stokes granulator fitted with a 12 mesh screen.

The minus 12 mesh red powder propellant product was stored in conductive plastic bags placed in metal containers.

The nominal composition of this batch was: 6.0% calcium carbonate, 4.32% potassium hydroxide, 13.91% phenolphthalein, 65.49% potassium nitrate, and 10.28% sulfur. Following drying at ambient conditions, the resulting red powder propellant contains from 1 to 3% moisture.

EXAMPLE 3

Tabletting of red powder propellant for the M127A1 signal rocket

Figure 3:
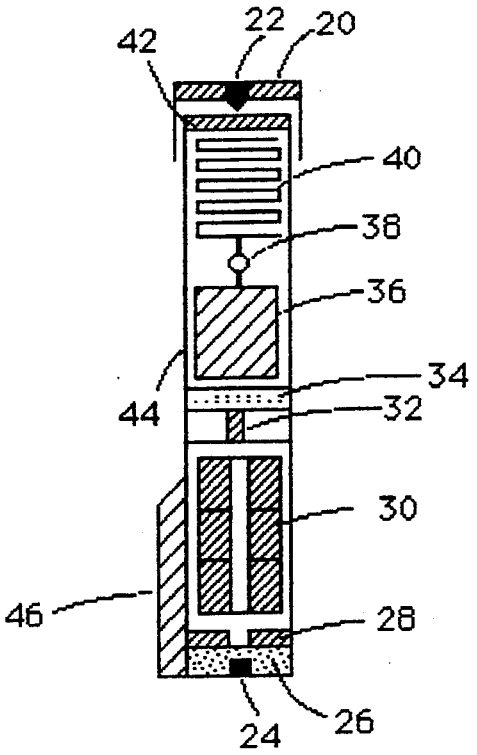
FIG. 3 is a schematic elevation in cross section of the hand-held M127A1 signal rocket.
Figure 4:
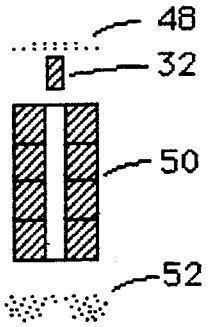
FIG. 4 is a schematic in exploded view of the initiating, expelling, delay, and propelling charges of FIG. 3.
Figure 5:
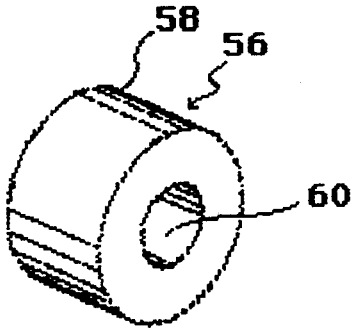
FIG. 5 is a perspective view of a red powder propellant shape according to the present invention.
Figure 6:
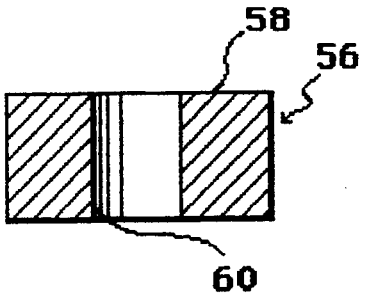
FIG. 6 is a cross sectional view of the propellant shape according to the present invention.
Figure 7:
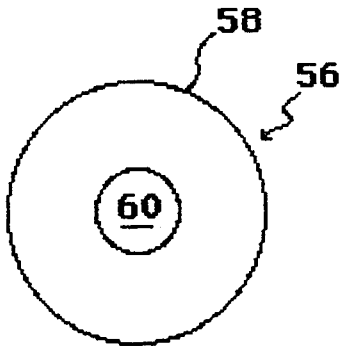
FIG. 7 is an end view of the propellant shape according to the present invention.

A commercial Stokes tabletting machine was used to produce consolidated red powder propellant in the form of propellant grains. The granular red powder propellant was consolidated at the same pressures and machine settings as for the production of conventional black powder propellant grains. The properties of the black powder propellant composition and propellant assembly are described under points 8 and 9 of the RAW MATERIAL AND EQUIPMENT section above, including the consolidated density specification of 1.82–1.89 grams per cubic centimeter. As a consequence of the lower bulk density of granular red powder propellant, the consolidated red powder propellant grains were shorter than the standard black powder propellant grains and weighed 9.5 grams instead of 13 grams. The consolidated density was 1.77 to 1.84 grams per cubic centimeter. To provide for a comparable weight of propellant per signal rocket, 4-grain red powder propellant assemblies were prepared instead of the 3-grain assemblies used for black powder propellant motors. The hand held signal rocket with four red powder propellant grains is shown in FIG. 4 as element 50. The three grain black powder propellant assembly is shown in FIG. 3 as element 30.

EXAMPLE 4

Testing of experimental M127A1 signal rockets

Granular red powder from Example 1 was used as a substitute for the black powder initiating charge (710 milligrams) in 17 experimental rockets, and as a substitute for the black powder expelling charge (750 milligrams) in 14 experimental rockets.

Red powder propellant, from Example 2 and consolidated as described in Example 3, was used in 15 experimental rockets in an amount of 38 grams per signal, coralspared to 39 grams of black powder propellant for the conventional signal rocket.

The rockets were test-fired from a launching tube set up in a field and directed into the atmosphere under a firing angle of 90 degrees.

The following description of the flight mechanism of the rocket is described with reference to FIG. 3.

The launch tube was equipped with a spring-release striker pin mounted at the bottom of the tube. The striker pin was remotely deployed by means of a pull wire. In manual launching, the percussion cap 24 is ignited by placing the firing cap 20 over the percussion end of the signal and by striking the cap with the palm of the hand. The striker pin 22, located in the center of the cap, hits the percussion cap 24 which then in turn ignites the initiating charge 26. The resulting explosive-flash expels the rocket from the signal casing 44 and simultaneously ignites the propelling charge 30. The hot propellant gases pass through venturi 28 which converts the gas pressure to kinetic energy. Metallic fins 46, in folded position in the tail assembly, unfold when the signal emerges from the launch tube and stabilize the flight of the signal rocket. A delay charge 32 is ignited after the rocket motor is consumed. At the end of the delay's burn time, the burn front ignites the expelling charge 34 and provides an explosive-flash to expel and light the rocket's payload. In the case of the M127A1 military hand-held signal rockets, the payload is an illuminant 36 attached by means of a link 38 to a parachute 40. The payload descends with a speed controlled by the parachute. Flight test data of the M127A1 signal rockets are set out in Table 1.

The following is apparent from Table 1.

(a) Initiating charge series 1: In all tests the flight angle was about constant and all signals flew virtually in a 90 degrees upward direction. This proves that the initiating charge functioned properly to launch the rocket, ignite the propellant motor and positioning the signal vertically for the subsequent flight. Should the initiating charge fail to launch the signal rocket or fail to ignite the propellant, the signal would take off under an unpredictable angle or burn in the launch tube or not function at all.

(b) Propelling charge series 2: The altitude reached is better than the minimum of 650–700 ft. The altitude reached is 30 ft., i.e. 3%, less than for the standard black powder propellant. Noteworthy is that the weight of the red powder propellant in the signal rocket was also about 2.5% less than the weight of black powder propellant weight in standard rockets. It is also very important to note that in all tests, the signals with red powder propellant burned and that none of the red powder propellant signals exploded.

(c) Expelling charge series 3: In all tests, the expelling charge functioned after ignition by the delay charge. All payloads were expelled and the illuminants lit. Should an expelling charge have failed a parachute would not have appeared.

In conclusion, granular and consolidated red powder are dispersions of alkali nitrate, sulfur and phenolphthalein in a binder of alkali phenolphthalein salt. In red powder propellant formulations, a heat decomposable solid carbonate is also present. Prepared compositions include:

(a) For use as an initiating or expelling charge in signal rockets a granular energetic composition comprising: (i) 1–5% by weight of potassium hydroxide; (ii) 69–75% by weight potassium nitrate; (iii) 9–11% by weight sulfur; (iv) 13–18% by weight phenolphthalein; and (v) 1–3% by weight water.

(b) For use as a propelling charge in signal rockets a consolidated granular energetic composition comprising: (i) 1–5% by weight of potassium hydroxide; (ii) 69–75% by weight potassium nitrate; (iii) 9–11% by weight sulfur; (iv) 5–10% by weight calcium carbonate; (v) 13–18% by weight phenolphthalein; and (vi) 1–3% by weight water.

TABLE 1

Field testing of M127A1 hand-held signals

BPP = Standard black powder propellant
BP = Standard black powder
BPD = Standard black powder delay
RPP = Red powder propellant
RP = Red powder

| Signal No. | 1A | 1B | 1C | 1D | 1E | 1F | 1G | 1H | 1I | 1J | 1K | 1L | 1M | 1N | 1O | 1P | 1Q | AVERAGE |
|---|---|---|---|---|---|---|---|---|---|---|---|---|---|---|---|---|---|---|
| INITIATING | RP | RP | RP | RP | RP | RP | RP | RP | RP | RP | RP | RP | RP | RP | RP | RP | RP | |
| Propelling | BPP | BPP | BPP | BPP | BPP | BPP | BPP | BPP | BPP | BPP | BPP | BPP | BPP | BPP | BPP | BPP | BPP | |
| Delay | BPD | BPD | BPD | BPD | BPD | BPD | BPD | BPD | BPD | BPD | BPD | BPD | BPD | BPD | BPD | BPD | BPD | |
| Expelling | BP | BP | BP | BP | BP | BP | BP | BP | BP | BP | BP | BP | BP | BP | BP | BP | BP | |
| Altitude (Ft) | 764 | 782 | 845 | 822 | 752 | 866 | 797 | 789 | 808 | 805 | 816 | 830 | 800 | 857 | 774 | 828 | 800 | 808 |
| Angle (Degrees) | 7 | 8 | 6 | 3 | 8 | 4 | 7 | 3 | 7 | 4 | 7 | 7 | 2 | 7 | 6 | 6 | 5 | 6 |

| Signal No. | 2A | 2B | 2C | D | 2E | 2F | 2G | 2H | 2I | 2J | 2K | 2L | 2M | 2N | 2O | AVERAGE |
|---|---|---|---|---|---|---|---|---|---|---|---|---|---|---|---|---|
| Initiating | BP | BP | BP | BP | BP | BP | BP | BP | BP | BP | BP | BP | BP | BP | BP | |
| PROPELLING | RPP | RPP | RPP | RPP | RPP | RPP | RPP | RPP | RPP | RPP | RPP | RPP | RPP | RPP | RPP | |
| Delay | BPD | BPD | BPD | BPD | BPD | BPD | BPD | BPD | BPD | BPD | BPD | BPD | BPD | BPD | | |
| Expelling | BP | BP | BP | BP | BP | BP | BP | BP | BP | BP | BP | BP | BP | BP | BP | |
| Altitude (Ft) | 767 | 674 | 782 | 762 | 792 | 712 | 782 | 784 | 819 | 750 | 764 | 674 | 814 | 797 | 745 | 761 |
| Angle (Degrees) | 13 | 4 | 2 | 7 | 7 | 4 | 2 | 1 | 7 | 5 | 2 | 6 | 1 | 5 | 7 | 5 |

| Signal No. | 3A | 3B | 3C | 3D | 3E | 3F | 3G | 3H | 3I | 3J | 3K | 3L | 3M | 3N |
|---|---|---|---|---|---|---|---|---|---|---|---|---|---|---|
| Initiating | BP | BP | BP | BP | BP | BP | BP | BP | BP | BP | BP | BP | BP | BP |
| Propelling | BPP | BPP | BPP | BPP | BPP | BPP | BPP | BPP | BPP | BPP | BPP | BPP | BPP | BPP |
| Delay | BPD | BPD | BPD | BPD | BPD | BPD | BPD | BPD | BPD | BPD | BPD | BPD | BPD | BPD |
| EXPELLING | RP | RP | RP | RP | RP | RP | RP | RP | RP | RP | RP | RP | RP | RP |
| Altitude (Ft) | 792 | 712 | 772 | 741 | 822 | 782 | 789 | 789 | 789 | 774 | 732 | 803 | 787 | 816 |
| Angle (Degrees) | 4 | 3 | 4 | 9 | 7 | 7 | 3 | 4 | 1 | 8 | 6 | 7 | 4 | 4 |

It is again pointed out that the effect of the phenolphthalein salt binder in the invention is very dramatic. Even at low concentrations of the binder, rapid rise times and a high pressure development, comparable to conventional black powder, are attained. These are generally advantageous when maximum pressures and minimum rise times are desired. It can also be seen that articles can contain both forms, i.e. red powder and red powder propellant as granular powders in loose form and as consolidated forms including grains, rods etc.

While the above description contains specific articles, processes and compositions, these should not be construed as limitations on the scope of the invention, but as an exemplification of preferred embodiments thereof. For example, skilled artisans will readily be able to change rocket dimensions, arrangements of parts, structures and quantities of ingredients to achieve specific purposes of particular devices or compositions.

I claim:

1. In a pyrotechnic device adapted to expel an illuminant or flare at a substantial elevation and having an initiating charge, a propelling charge, a delay charge and an expelling charge, said charges having a cooperating relationship to cause sequential reaction of the charges and expulsion of the flare or illuminant, the improvement characterized by having at least one ctnarge being a red powder energetic composition comprising a dispersion of an alkali metal nitrate, sulfur and phenolphthalein in a binding phase, the binding phase being an alkali metal phenolphthalein salt.

2. The pyrotechnic device of claim 1 wherein at least one red powder charge is comprised of granules.

3. The pyrotechnic device of claim 1 wherein at least one red powder charge is in a consolidated form.

4. The article of claim 1 wherein the consolidated red powder charge is in the form of consolidated granules,

5. The pyrotechnic device of claim 1 wherein there are at least two red powder charges and having at least one charge in the form of granules and at least one charge in a consolidated form.

6. The device of claim 4 wherein the red powder charge includes the propelling charge.

7. The device of claim 6 wherein the propelling charge has four grains.

* * * * *